US006210269B1

(12) United States Patent
Tesche et al.

(10) Patent No.: US 6,210,269 B1
(45) Date of Patent: Apr. 3, 2001

(54) OSCILLATING DRIVE FOR AIR FLOW DISCHARGE

(75) Inventors: Carlos Alfonso Tesche, Canoas; Juan Carlos Carne Correa, Porto Alegre, both of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/485,560

(22) PCT Filed: Jun. 22, 1998

(86) PCT No.: PCT/BR98/00037

§ 371 Date: Feb. 14, 2000

§ 102(e) Date: Feb. 14, 2000

(87) PCT Pub. No.: WO99/67577

PCT Pub. Date: Dec. 29, 1999

(51) Int. Cl.[7] ..... F24F 7/00
(52) U.S. Cl. ..... 454/316; 454/318; 454/321
(58) Field of Search ..... 454/286, 305, 454/313, 315, 316, 318, 319, 321, 202

(56) References Cited

U.S. PATENT DOCUMENTS 4,938,122 * 7/1990 Ziemba ..... 454/305

FOREIGN PATENT DOCUMENTS 4424904 1/1995 (DE) .
05212193 8/1993 (EP) .
811810 12/1997 (EP) .

* cited by examiner

*Primary Examiner*—Stephen Gravini
*Assistant Examiner*—Jiping Lu

(57) ABSTRACT

An oscillating drive mechanism for an air discharge nozzle, which is mounted for pivotal movement about an axis. The discharge nozzle includes end plates, each having a pivot pin extending along the pivot axis. One end plate has an elongated slot therein spaced from the pivot pin. The pivot pins are supported at opposite ends by support structure, which allows pivotal movement of the nozzle about the axis. The support structure adjacent one end includes an opening therethrough spaced from the axis and configured such that the elongated slot and one end plate will sweep across the opening as the air discharge nozzle pivots through a predetermined desired arcuate sweep. A drive motor having a drive axis is attached on the opposite side of the support structure, opposite the through opening. A drive mechanism is disposed in the opening. The drive mechanism is coupled to the drive motor on one side thereof and has a drive pin on the other side thereof, which is driven in an orbiting pattern around the motor drive axis. The drive pin is configured to engage the elongated slot in the end plate and to traverse the slot in alternating directions as the motor rotates the drive mechanism to thereby cause the air discharge nozzle to oscillate through the predetermined arcuate sweep.

3 Claims, 6 Drawing Sheets

OSCILLATING DRIVE FOR AIR FLOW DISCHARGE

TECHNICAL FIELD

The invention generally relates to air distribution units of the type commonly used in air conditioning, heating or ventilation systems and, more particularly, to a drive mechanism for an oscillating discharge louver assembly for such a unit.

BACKGROUND ART

In many commercial air conditioning, heating and ventilating systems, treated air is discharged into an area to be conditioned through an air distribution or conditioning unit. For example, one general type of air conditioning system, often referred to as a split system, includes separate indoor and outdoor units. The outdoor unit includes a compressor, a heat exchanger and a fan. The indoor unit includes a heat exchanger and a fan. In operation, the indoor fan draws air into the indoor unit, through an inlet thereof, and forces the air over the indoor heat exchanger and then out of the indoor unit, through an outlet opening therein.

The outdoor fan draws air into the outdoor unit, through an inlet, forces that air over the outdoor heat exchanger and then forces that air out of the outdoor unit through an outlet therein. At the same time, a compressor causes a refrigeration fluid to circulate through and between the indoor/outdoor heat exchangers. At the indoor heat exchanger, the refrigerant absorbs heat from the air passing over that heat exchanger, cooling that air. At the same time, at the outdoor heat exchanger, the air passing over the heat exchanger absorbs heat from the refrigerant passing therethrough. Typically, a louvered assembly is disposed in the outlet of the indoor unit to direct the air discharge from that unit at a preferred angle.

It is considered desirable for the louvered air discharge to be provided with an arrangement whereby the louvers are oscillated to vary the direction of air flow from the discharge assembly.

DISCLOSURE OF THE INVENTION

An oscillating drive mechanism for an air discharge nozzle, which is mounted for pivotal movement about an axis. The discharge nozzle includes end plates, each having a pivot pin extending along the pivot axis. One end plate has an elongated slot therein spaced from the pivot pin. The pivot pins are supported at opposite ends by support structure, which allows pivotal movement of the nozzle about the axis. The support structure adjacent one end includes an opening therethrough spaced from the axis and configured such that the elongated slot and one end plate will sweep across the opening as the air discharge nozzle pivots through a predetermined desired arcuate sweep. A drive motor having a drive axis is attached on the opposite side of the support structure, opposite the through opening. A drive mechanism is disposed in the opening. The drive mechanism is coupled to the drive motor on one side thereof and has a drive pin on the other side thereof, which is driven in an orbiting pattern around the motor drive axis. The drive pin is configured to engage the elongated slot in the end plate and to traverse the slot in alternating directions as the motor rotates the drive mechanism to thereby cause the air discharge nozzle to oscillate through the predetermined arcuate sweep.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
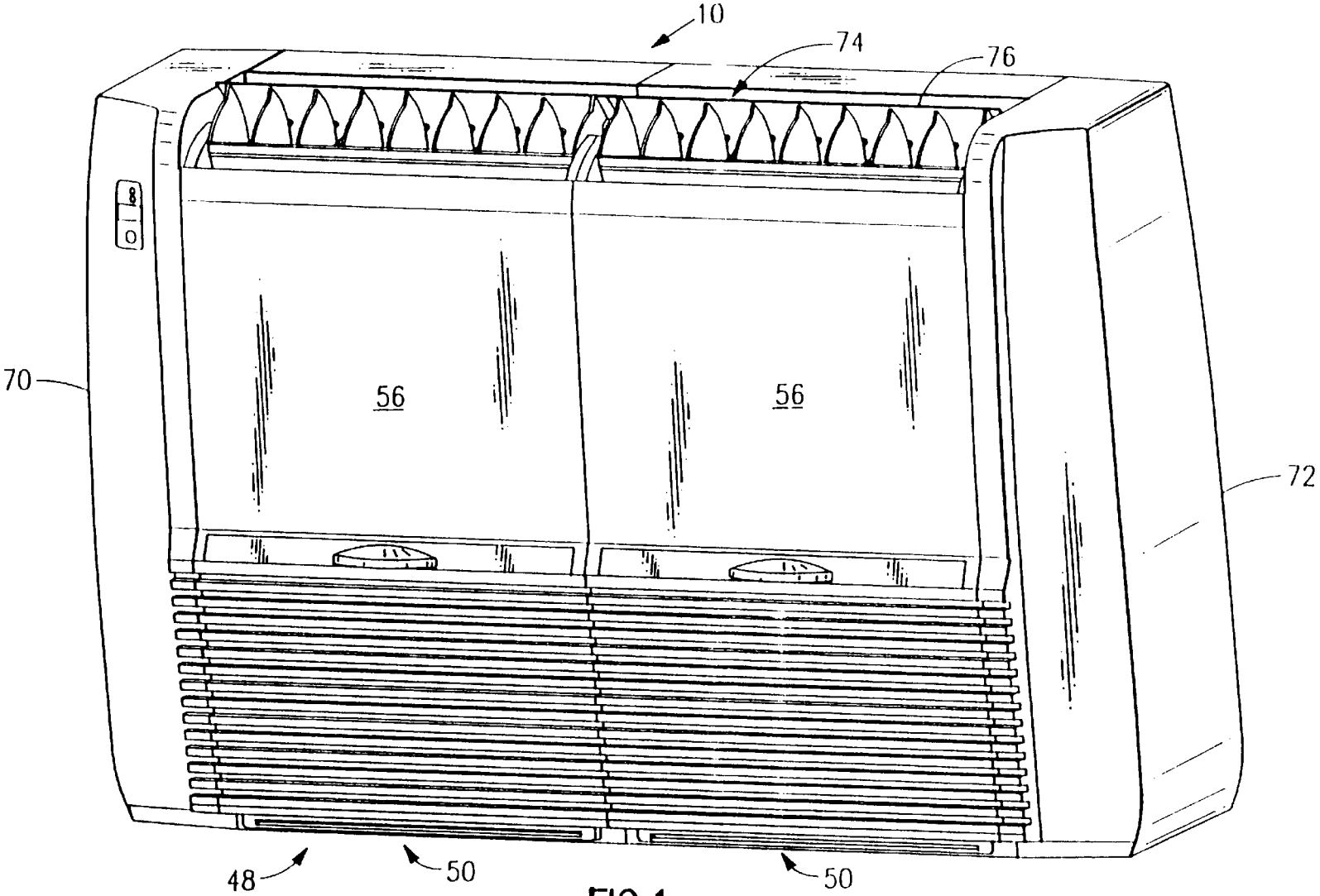
FIG. 1 is a perspective view of the indoor unit of an air conditioner which embodies the features of the present invention.
Figure 6:
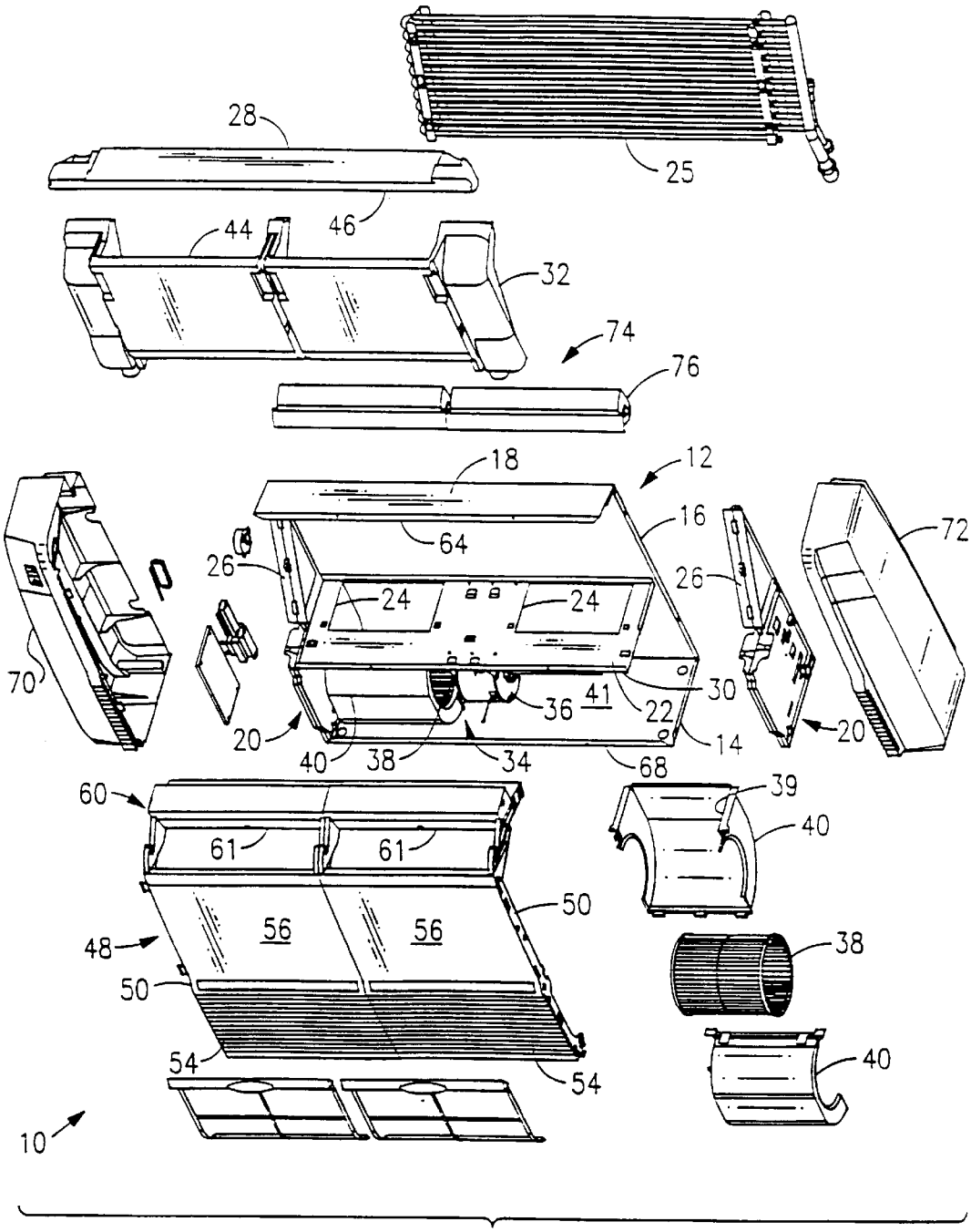
FIG. 6 is an exploded perspective view of the air conditioning unit of FIG. 1.

Looking first at FIGS. 1 and 6, the indoor unit 10 of a split system air conditioning system of the type incorporating an oscillating drive for the air flow discharge louver assembly according to the present invention is illustrated. Briefly, the unit 10 includes a main structural support frame 12, which includes a bottom panel 14, a back panel 16 and a top section 18. Attached to the sides of the back and top panels are structural internal side covers 20. The side covers 20 and the back panel 16 cooperate to support a horizontally extending fan support panel 22, which includes a pair of rectangular openings formed therein. Mounted above the fan support panel 22 on a pair of inclined surfaces 26, defined by the internal side covers 20 is a heat exchanger coil 25.

Mounted under the top section of the main support frame 12 is an upper condensate collection pan 28. Mounted in the front of the unit, under the bottom of the heat exchanger 25, and supported by the front edge 30 of the fan support panel 22, is a lower condensate collection pan 32. A front section of the lower condensate collection pan extends upwardly and is spaced from the heat exchanger coil 25.

Mounted to the lower surface of the fan support panel 22 is a fan assembly 34, which includes an electric motor 36 adapted to drive a pair of centrifugal fans 38, which are each enclosed in a two-piece scroll housing 40. Each of scroll housings 40 defines a rectangular upper air outlet opening 39, which is in air flow communication with the rectangular openings 24 in the fan support panel 22.

As a result of the above-described arrangement of components, when the fan assembly is energized, air is drawn into the region 41 underlying the fan support panel 22 through the open front and is directed upwardly through the rectangular openings 24, through the heat exchanger coil 25 and is discharged through an opening 42 defined by the upper edge 44 of the lower condensate pan 32 and the front edge 46 of the upper condensate pan 28.

Reference numeral 48 refers generally to a front and top cover section assembled from two separate modular panels, which form the subject matter of an invention disclosed and claimed in another application assigned to the assignee of the present invention and filed on even date herewith. Each modular panel 50 generally includes a planar front section 52, which includes a lower louvered portion 54, which is in fluid flow communication with the region 41 underlying the fan panel to thereby define the air inlet to the unit. A solid section 56 of the planar front panel overlies a planar front section 58 of the lower condensate pan 32. Extending rearwardly from the upper end of the planar front section 52 of each modular panel 50 is a top section 60, which defines a rectangular air discharge opening 61, which overlies the discharge opening 42 described hereinabove. The top section 60 also includes a substantially horizontally extending section 62, which overlies and covers the top 18 of the main structural support frame 12.

The front cover 48 is attached to the unit by means of threaded fasteners interconnecting the upper horizontal section 62 with a flange 64 on the top 18 of the main structural support, and by additional threaded fasteners interconnecting the front cover with a flange 66 on the front of the fan panel 22 and a flange 68 provided on the front of bottom 14 of the main structural support. Left and right external side covers 70 and 72, respectively, are suitably attached to the internal side covers 20 and the left and right-hand sides of the cover assembly 48.

Figure 7:
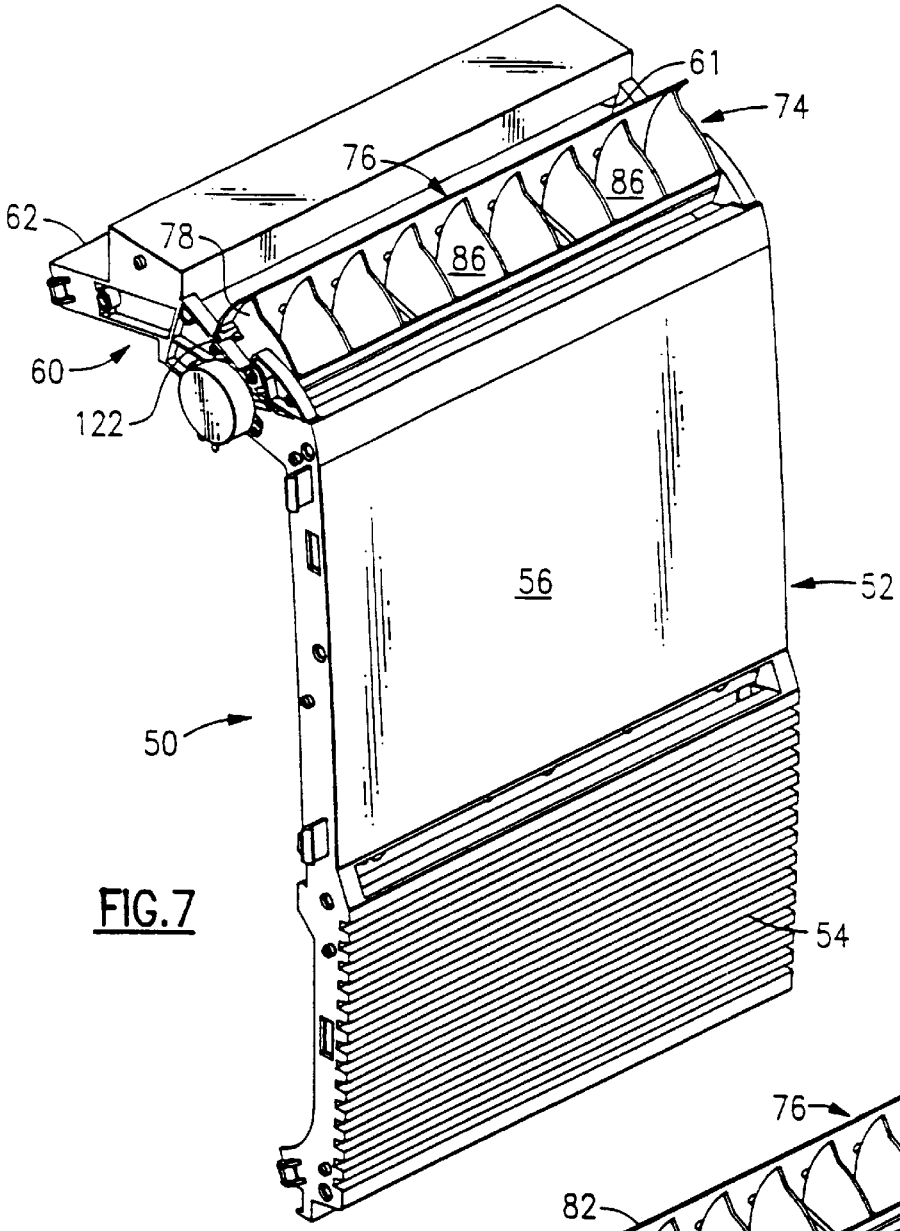
FIG. 7 is an enlarged view of a modular front panel of the unit of FIG. 1.
Figure 8:
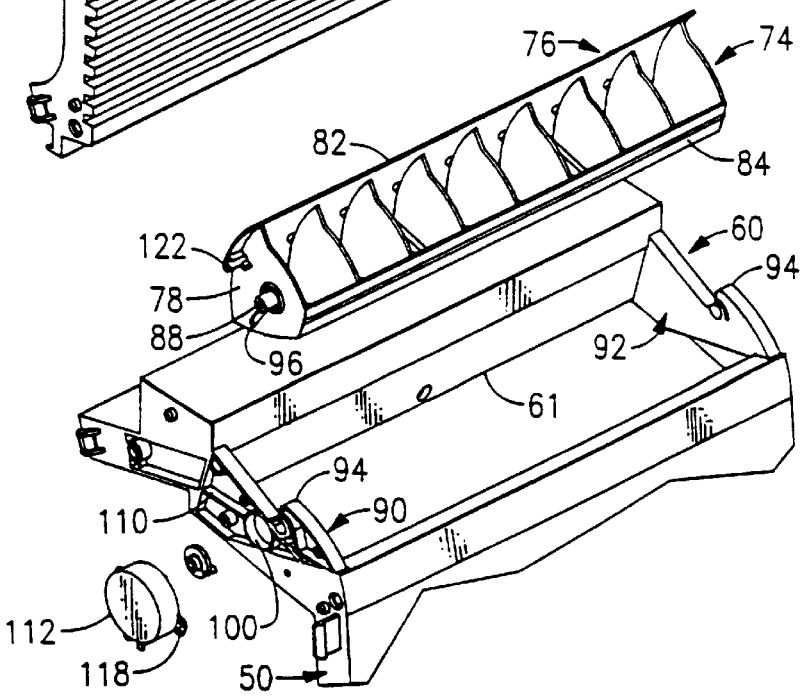
FIG. 8 is an enlarged top view of the front panel of FIG. 7 with the louver assembly and the motor and oscillating drive element exploded therefrom.

As best seen in FIGS. 7 and 8, an air discharge louver assembly 74 is adapted to be mounted within the rectangular air discharge opening 61 of each of the modules 50. Each louver assembly 74 comprises an elongated air directing housing 76 having left and right end walls 78 and 80, respectively, which in turn are interconnected by an elongated longitudinally extending upper wall 82 and a longitudinally extending lower wall 84. Mounted within the housing 76 and extending vertically between the upper and lower walls 82 and 84 are a series of flat pivotally mounted air deflectors 86, which are arranged to be manually displaced in a left to right orientation to thereby direct the flow of air thereby, as is conventional.

The left and right end walls 78 and 80 are each provided with a centrally located pivot mount pin 88. As best seen in FIG. 8, the rectangular air discharge opening 61 is bounded by left and right side walls 90 and 92, respectively. Each of these walls is provided with a pivot pin receiving structure 94, which is adapted to receive the pivot pins 88 of the left and right end walls 78 and 80 in a snap-fit fashion, which allows free pivoting of the louver assembly 74 about the pivot pins once installed to these receiving structures. Once installed in this relationship within the air discharge opening, the discharge flow of air passes through the louver assembly housing 76 as it exits from the air conditioning unit.

Figure 9:
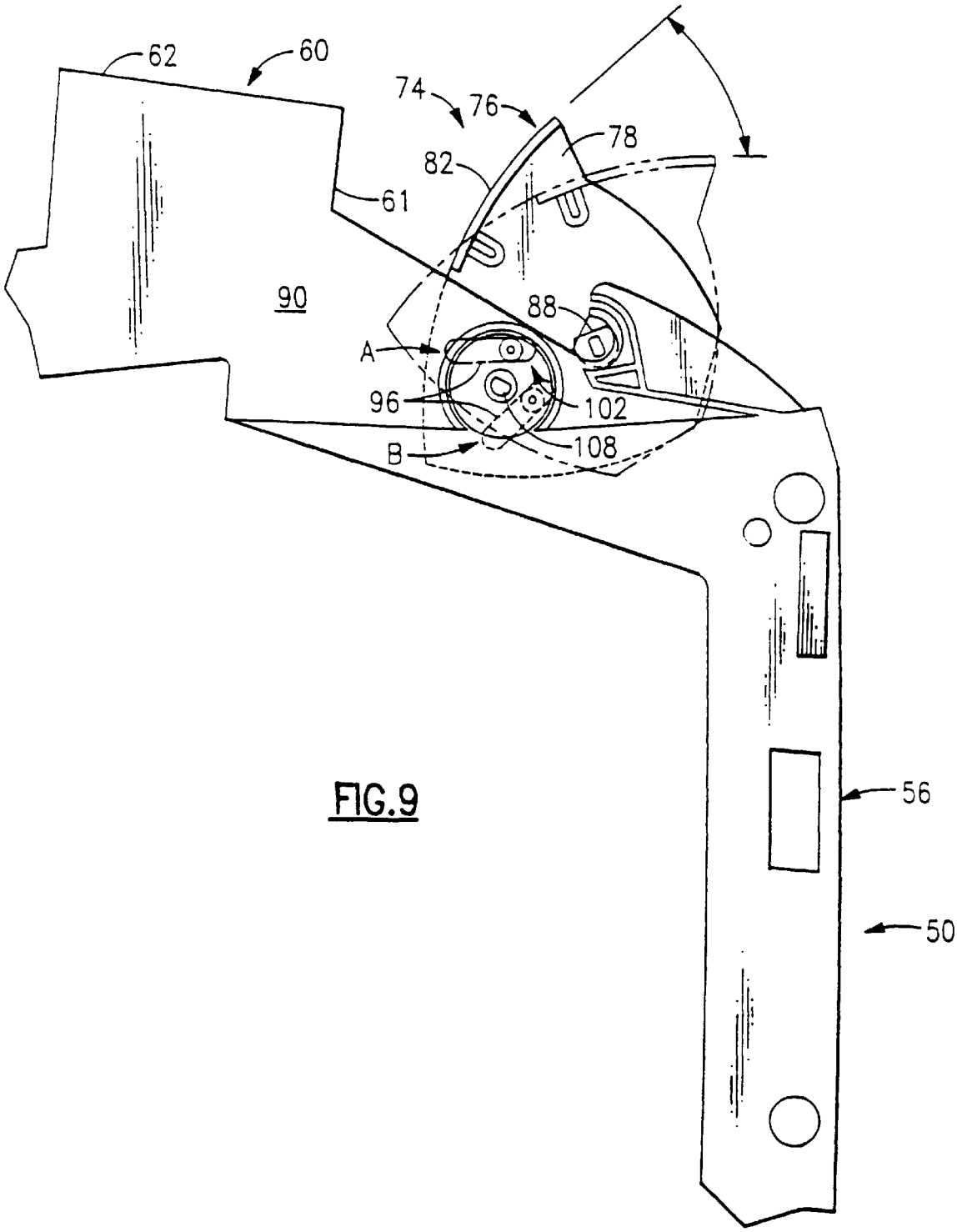
FIG. 9 is a simplified side view of an outer cover assembly showing the range of motion of the louver assembly and the orientation of the drive element with respect to the louver assembly.

As best seen in FIG. 9, the indoor unit 10 is provided with a louver assembly oscillating mechanism, which is adapted to oscillate the louver assembly housing 76 between a first position, as indicated in solid lines in FIG. 9, to a second position as indicated in phantom lines in FIG. 9. The oscillating mechanism when actuated will cause the housing to oscillate continuously between these two positions.

Figure 2A:
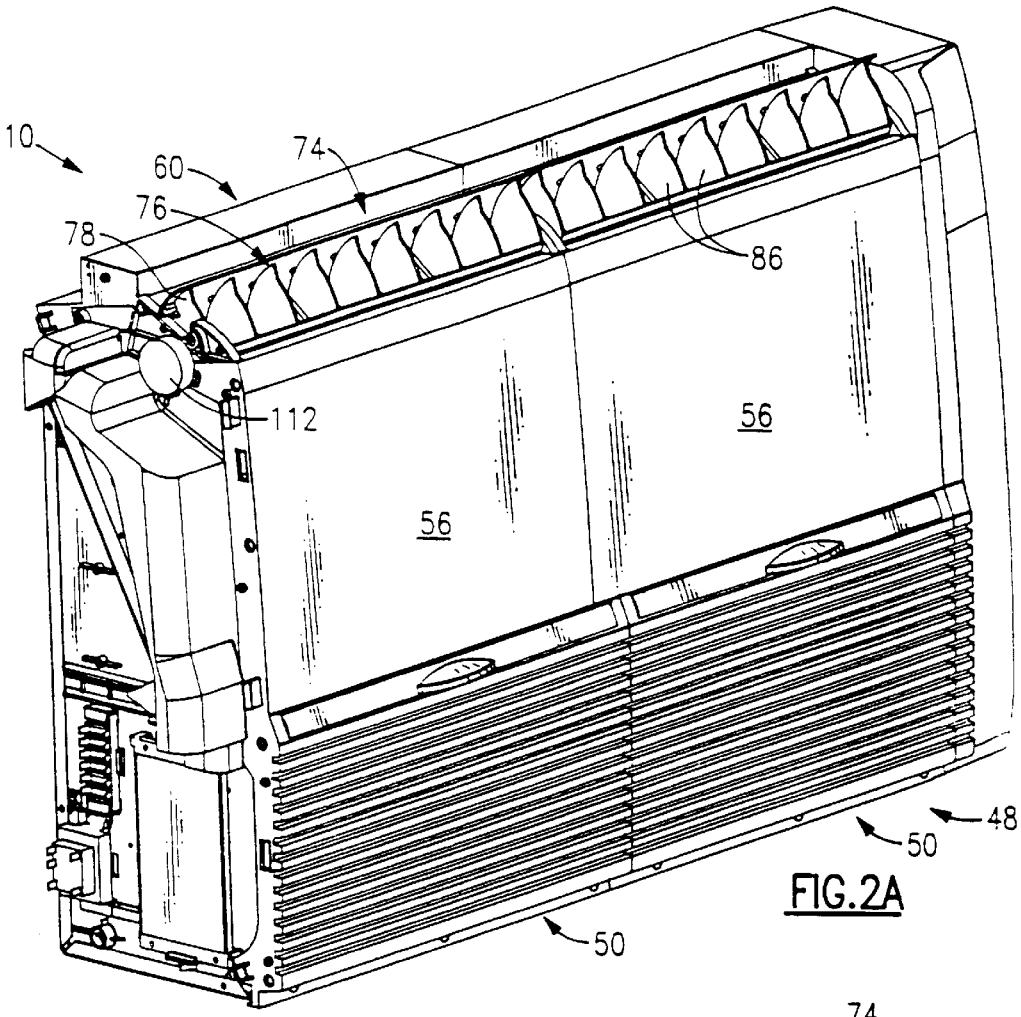
FIG. 2A is a perspective view showing the unit illustrated in FIG. 1 with the left side cover and one of the front modular panels removed therefrom.
Figure 2B:
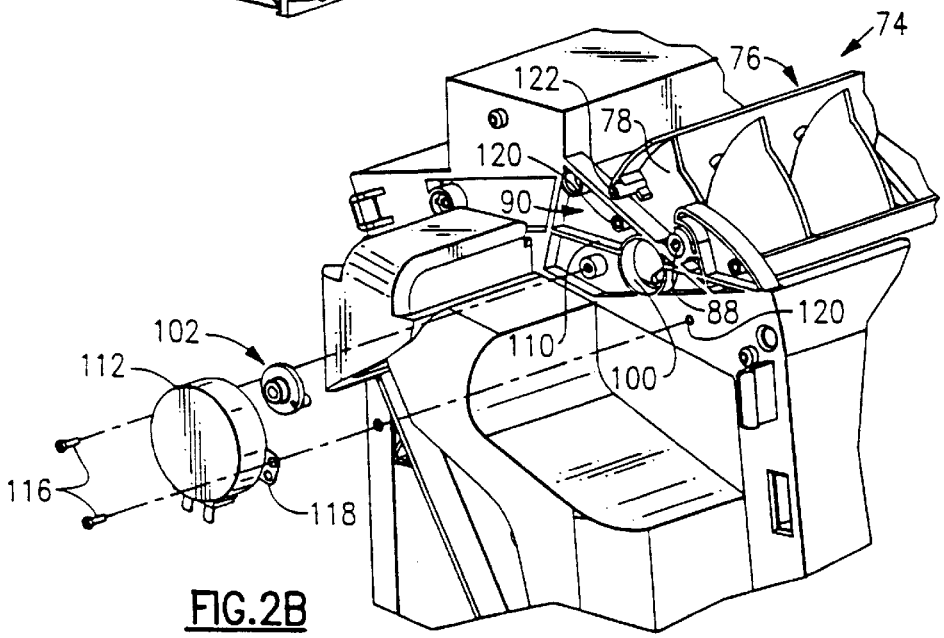
FIG. 2B is an enlarged perspective view of the upper left-hand corner of the unit of FIG. 2A showing the drive motor and oscillating drive element exploded therefrom.

The oscillating mechanism includes an elongated slot 96 positioned in left-hand end wall 78 of the louver assembly housing 76. The slot 96, has a longitudinal axis, which intersects with the axis of the pivot pins 88. As best seen in FIGS. 2B, 8 and 9, a circular through opening 100 is provided in left-hand side wall 90 of the air discharge opening 61. The circular opening 100 is located rearwardly and downwardly from the pivot pin 88 axis and, as best seen in FIG. 9, is sized such that the elongated slot 96 will sweep between the position shown in phantom lines and identified as position "A" when the louver housing 76 is in the extreme clockwise position in FIG. 9 and to the position identified as position "B" when the louver housing 76 is in the extreme counter clockwise position.

Figure 5:
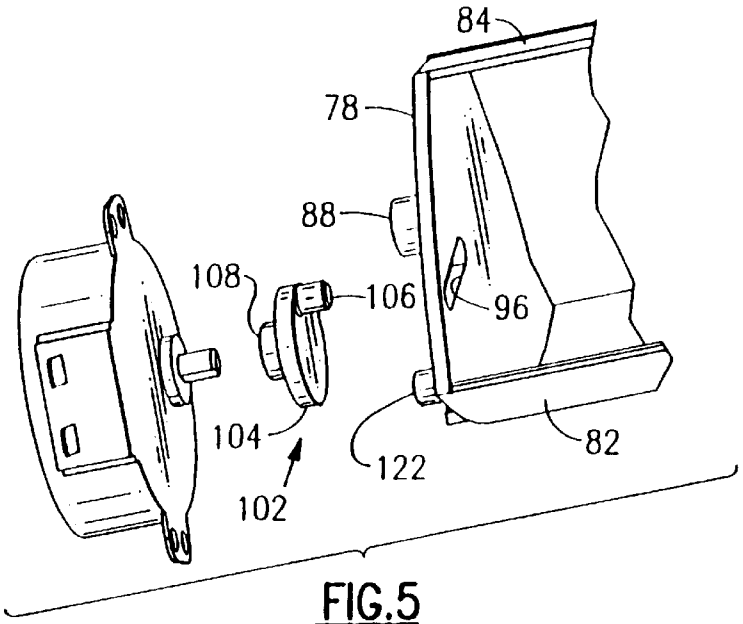
FIG. 5 is an exploded view illustrating the engagement between the oscillating drive element and louver assembly of FIG. 3.
Figure 4:
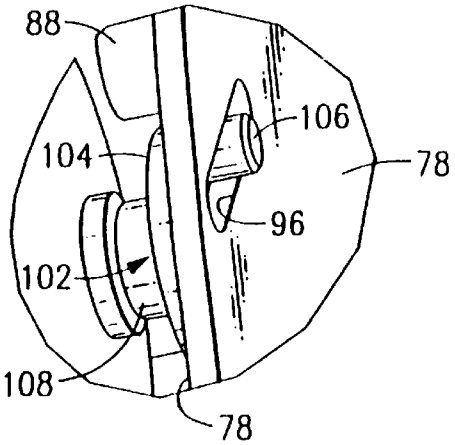
FIG. 4 is an enlarged view showing the detail identified as FIG. 4 in FIG. 3.

As best seen in FIGS. 4 and 5, an oscillating drive element 102 having a main circular section 104 and a crank pin 106 mounted on the outer periphery thereof is adapted to pass through the opening 100 with the crank pin 106 sized to be slideably received within the slot 96 in the louver housing 76. Mounted on the other side of the main circular section 104 of 10 the oscillating drive element 102 is a centrally located drive shaft receiving socket 108.

Mounted on the outer surface 110 of the left side wall 90 is a synchronous motor 112 having a reduction gear drive having an output shaft 114 adapted to be received in the drive socket 108 of the oscillating drive element 102. The motor 112 is mounted by suitable threaded fasteners 116 passing through mounting flanges 118 and received in axially aligned openings 120 in the outer surface 110 of the side wall 90.

The output speed of the synchronous motor is on the order of several revolutions per minute and is continuous in the same rotational direction. Continuous actuation of the motor 112 will result in rotation of the oscillating drive element 102 and orbiting of the crank pin 106 about the central axis of the oscillating element 104. Such motion of the crank pin will cause the pin to translate back and forth within the slot 96 thereby driving the louver assembly housing 76, through the end wall 78, between the positions illustrated in FIG. 9, as described above.

Figure 3:
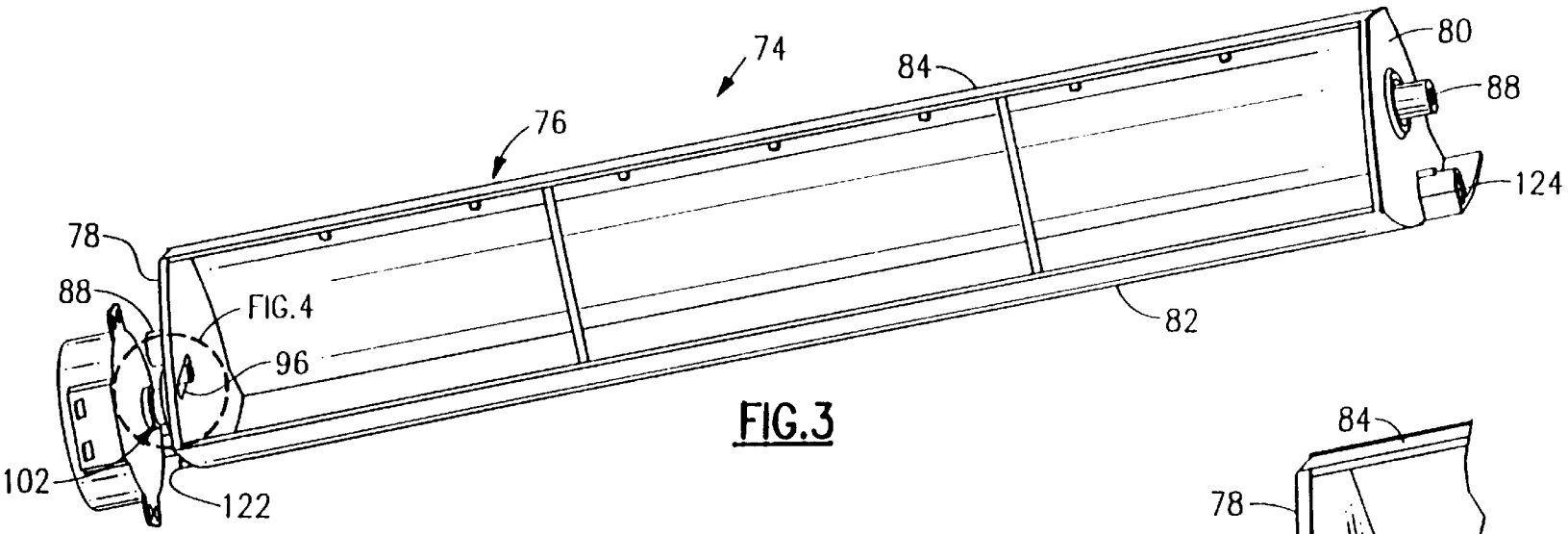
FIG. 3 is an enlarged perspective bottom view showing the air flow discharge assembly of the air conditioning unit of FIG. 1 with the louvers removed therefrom to show detail of the drive mechanism.

While the oscillating drive mechanism has been described in connection with driving a single louver assembly 74 mounted in a single modular panel 50, it should be appreciated that it is capable of driving several interconnected louver assemblies. As best seen in FIG. 6, where two modular panels 50 are shown interconnected, each panel is provided with its own air discharge opening 61, which is bounded by left and right side walls 90 and 92. Each of these sets of side walls 90 and 92 is provided with the above-described pin receiving structure 94 and is adapted to receive mating pins 88 of the louver assembly 74 therein. Adjacent louvers are interconnected in series fashion by pin and socket assemblies. As best seen in FIG. 8, the left-hand end wall 78 of each louver assembly is provided with a pin 122 extending outwardly therefrom adjacent to and underlying the upper wall 82. As best seen in FIG. 3, the right-hand end wall 80 of each louver assembly housing 76 is provided with a socket 124 located under the upper wall 82 thereof and in axial alignment with the pins 122. Accordingly, two or more adjacent louver assemblies may be interconnected and driven by a single oscillating drive mechanism.

What is claimed is:

1. An oscillating drive mechanism of the type having an air discharge nozzle mounted for pivotal movement about an axis wherein the improvement comprises:

an end plate on said air discharge nozzle having a pivot pin extending therefrom along said axis, said end plate further having an elongated slot therein spaced from said pivot pin;

support structure, having a first side and a second thereof, said first side being positioned adjacent to and parallel to said end plate, said support structure including mating structure disposed along said axis for receiving and retaining said pivot pin to allow pivotal movement of said plate and said nozzle about said axis, said support structure having an opening therethrough spaced from said axis, said opening being configured such that said elongated slot will sweep across said opening as said air discharge nozzle pivots through a predetermined desired arcuate sweep;

a drive motor attached to said second side of said support structure proximate said opening, said motor having a drive shaft extending into said opening, said drive shaft being configured to be rotatably driven about an axis parallel to said pivot axis of said air discharge nozzle;

a drive mechanism rotatably disposed in said opening, one side of said drive mechanism being adjacent said end plate, said one side being rotatably coupled to said motor drive shaft for rotation of said drive mechanism by said motor drive shaft, the other side having a drive pin thereon spaced from said rotational axis of said drive shaft so that said pin is driven in an orbit about said motor axis, said drive pin being configured to engage said elongated slot, and to traverse said slot in alternating directions as said motor rotates said drive mechanism to thereby cause said air discharge nozzle to oscillate through said predetermined arcuate sweep.

2. The apparatus of claim 1 wherein said drive motor is a synchronous motor.

3. The apparatus of claim 2 wherein said synchronous motor has a reduction gear drive.

* * * * *